US008434988B2

(12) United States Patent
Tonti et al.

(10) Patent No.: US 8,434,988 B2
(45) Date of Patent: May 7, 2013

(54) ROTARY SEAMER

(75) Inventors: Stefano Tonti, Parma (IT); Roberto Catelli, Parma (IT)

(73) Assignee: CFT S.p.A., Parma (IT)

( * ) Notice: Subject to any disclaimer, the term of this patent is extended or adjusted under 35 U.S.C. 154(b) by 440 days.

(21) Appl. No.: 12/682,004

(22) PCT Filed: Aug. 29, 2008

(86) PCT No.: PCT/IB2008/053521

§ 371 (c)(1),
(2), (4) Date: Apr. 7, 2010

(87) PCT Pub. No.: WO2009/047659

PCT Pub. Date: Apr. 16, 2009

(65) Prior Publication Data

US 2010/0218457 A1 Sep. 2, 2010

(30) Foreign Application Priority Data

Oct. 9, 2007 (IT) ..... PR2007A0075

(51) Int. Cl.
*B21D 51/30* (2006.01)
*B21D 51/32* (2006.01)

(52) U.S. Cl.
USPC ..... 413/27; 413/31

(58) Field of Classification Search ..... 413/27, 413/31; 53/334, 338, 340
See application file for complete search history.

(56) References Cited

U.S. PATENT DOCUMENTS

| | | | | |
|---|---|---|---|---|
| 2,680,419 | A | 6/1954 | Peterson, Jr. et al. | |
| 4,838,064 | A | 6/1989 | Päss | |
| 4,961,300 | A | 10/1990 | Mihara et al. | |
| 5,358,369 | A * | 10/1994 | Katou et al. | 413/27 |
| 5,376,174 | A | 12/1994 | Sommer | |
| 5,839,869 | A * | 11/1998 | Moran et al. | 413/31 |
| 2004/0062625 | A1 | 4/2004 | Egerton et al. | |
| 2005/0103076 | A1 | 5/2005 | Lentz et al. | |
| 2007/0211978 | A1 | 9/2007 | Engesser et al. | |

FOREIGN PATENT DOCUMENTS

| | | | |
|---|---|---|---|
| DE | 244 924 | A1 | 4/1987 |
| DE | 37 11 927 | C1 | 10/1988 |
| DE | 43 13 451 | A1 | 10/1994 |
| DE | 197 19 537 | A1 | 11/1998 |
| DE | 102 17 933 | A1 | 11/2003 |
| DE | 10 2004 012 113 | A1 | 9/2005 |

(Continued)

*Primary Examiner* — Teresa M Ekiert
(74) *Attorney, Agent, or Firm* — Pearne & Gordon LLP

(57) ABSTRACT

A rotary seamer (1) is provided with a carousel (2) and with at least one seaming station (3) associated with the carousel (2) and comprising a rod-like element (6) rotating around its own longitudinal axis, a seaming tool (4) rotatably connected to a lever (5) integral with the rod-like element (6) and means for rotating the rod-like element (6) around its own longitudinal axis, in such a way as to displace the seaming tool (4) from an operative position, in which it interacts with an object seaming it, to a deactivated position, of non interference with the object; said means comprising an electric motor (7) associated with the carousel and kinetically to the rod-like element (6) and control means operatively active on the electric motor (7) to rotate the rod-like element (6) according to a predefined logic. In known seamers the actuation of the seaming tool is achieved by means of a cam, this entailing limitations and drawbacks in the adaptation of the seamer to the treatment of different objects.

17 Claims, 4 Drawing Sheets

FOREIGN PATENT DOCUMENTS

| | | | |
|---|---|---|---|
| DE | 10 2005 018 160 | A1 | 10/2006 |
| DE | 10 2006 010 655 | A1 | 9/2007 |
| EP | 0 290 874 | A2 | 11/1988 |
| EP | 0 322 843 | A1 | 7/1989 |
| EP | 0 543 196 | A1 | 5/1993 |
| EP | 1 230 999 | A1 | 8/2002 |
| EP | 1 480 768 | | 9/2003 |
| WO | 93/15957 | A1 | 8/1993 |
| WO | 96/35529 | A1 | 11/1996 |
| WO | 03/074208 | A1 | 9/2003 |

* cited by examiner

ROTARY SEAMER

TECHNICAL FIELD AND BACKGROUND ART

The present invention relates to a rotary seamer.

A seamer is a machine that enables to apply a lid to a container to close it hermetically, connecting the edge of the lid to the edge of the container by folding them onto each other.

Objects to be seamed generally have cylindrical geometry, e.g. they are constituted by pots or cans.

In practice, seaming is achieved by setting the container in rotation around its own axis, e.g. associating it to a mandrel and making it interact with a seaming tool, which in turn is rotating and appropriately shaped, i.e. shaped in such a way as to cause said folding of the container and of the corresponding lid.

In prior art solutions, the seaming tool is constituted by an idle roller.

Said roller is connected to an end of a lever integral with a rotating pivot. In this way, by rotating the pivot the roller is approached to or moved away from the object, moving the roller from an operative position, in which it interacts with the object seaming it, to a deactivated position, of non interference with the object.

The pivot, which consists of a rod-like element, is rotatably connected to a carousel, and it is rotated by interaction with a cam.

Moreover, in rotary seamers the treated objects are imparted a rotating motion around their own axis and a revolution motion around the axis of rotation of the carousel.

In this light, note that the velocity of rotation of the container around the axis of the carousel is linked to the speed of the production line, i.e. to the hourly rate of production of containers treated by the seamer. Instead, the rotation of the container around its own axis is linked to the finishing of the seaming process, said finishing increasing with the increase in the number of seaming turns, where the term "number of seaming turns" means the number of rotations the container completes relative to its own axis during the seaming of the lid.

The evolution of the materials of containers and lids requires ever more to advanced machinery to have better seaming results.

Moreover, the considerable differences within the range of the objects to be seamed, e.g. in terms of diameter or thickness or material used, imposes the need to adapt the seamer according to each case.

Therefore, seamers in use are provided with probes to measure the distance between the object to be seamed and the roller, and with systems to adjust said distance mechanically (and manually); the displacement of the roller is determined by the shape of the cam.

This entails two kinds of problems.

In the first place, said mechanical adjustments are complicated and costly and they are difficult to perform with precision (because they have to be carried out manually).

Secondly, the profile of the cam has to be redesigned in relation to the situation whereto corresponds the maximum rotation of the pivot; consequently, the profile of the cam is not optimized in all other situations.

Another problem is to vary the number of seaming turns. To increase the versatility of the seamer in handling containers and lids made of materials with different mechanical characteristics, it is necessary to be able to vary the number of seaming turns rapidly.

In this regard, while in known seamers the variation of the number of seaming turns is possible, it entails interventions that are costly in terms of time and of materials. In prior art solutions, changing the number of seaming turns requires replacing a series of gears or pulleys (situated with the body of the machine or possibly outside it) whose function is to transfer motion from a motorization to the mandrel that sets in rotation the object to be seamed.

This solution, in addition to being disadvantageous in terms of times and costs, presents the drawback of requiring to vary the velocity of rotation of the object. This solution does not allow to increase the number of seaming turns, for equal velocity of the object, by increasing the time during which the roller interacts with the object.

Additional technical problems are associated with the rollers.

A first problem derives from the need to house lubricated bearings within the roller, to allow it to rotate easily and freely; this is disadvantageous because it compromises the hygiene of the machines and the stiffness of the roller itself.

Another problem is determined by the fact that the impact between the roller and the object to be seamed (in the moment when they come in contact) entails a deterioration of the surfaces that come in contact, with inevitable failures due to the jamming of the machine caused by the material removed in said impact.

DISCLOSURE OF THE INVENTION

An object of the present invention is to eliminate the aforesaid drawbacks and make available a rotary seamer that is particularly versatile, reliable and easy to adjust.

Said object is fully achieved by the seamer of the present invention, which is characterized by the content of the appended claims and in particular in that said means for rotating the rod-like element comprise, in combination:

- an electric motor associated with the carousel;
- means for connecting the rod-like element to the electric motor;
- control means operatively active on the electric motor to rotate the rod-like element according to a predefined logic.

BRIEF DESCRIPTION OF DRAWINGS

This and other characteristics shall become more readily apparent from the following description of a preferred embodiment, illustrated purely by way of non limiting example in the accompanying drawing tables, in which.

BEST MODE FOR CARRYING OUT THE INVENTION

In the figures, the reference 1 indicates a seamer according to the present invention. The seamer 1 is a rotary seamer, comprising a carousel 2 rotating around its own longitudinal axis.

Figure 3:
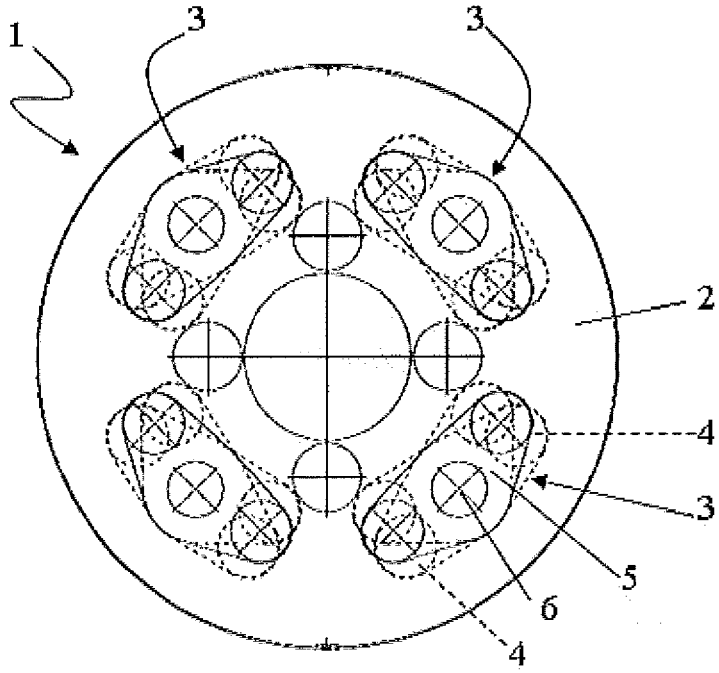
FIG. 3 shows a sectioned view of the seamer of FIG. 1, according to the plane indicated by the reference A in FIG. 1.
Figure 4:
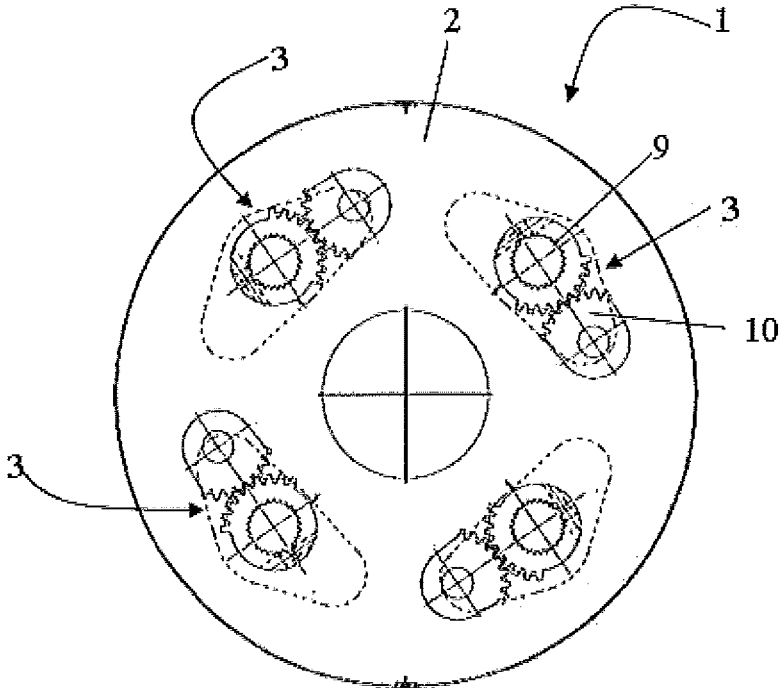
FIG. 4 shows a sectioned view of the seamer of FIG. 1, according to the plane indicated by the reference B in FIG. 1.
Figure 5:
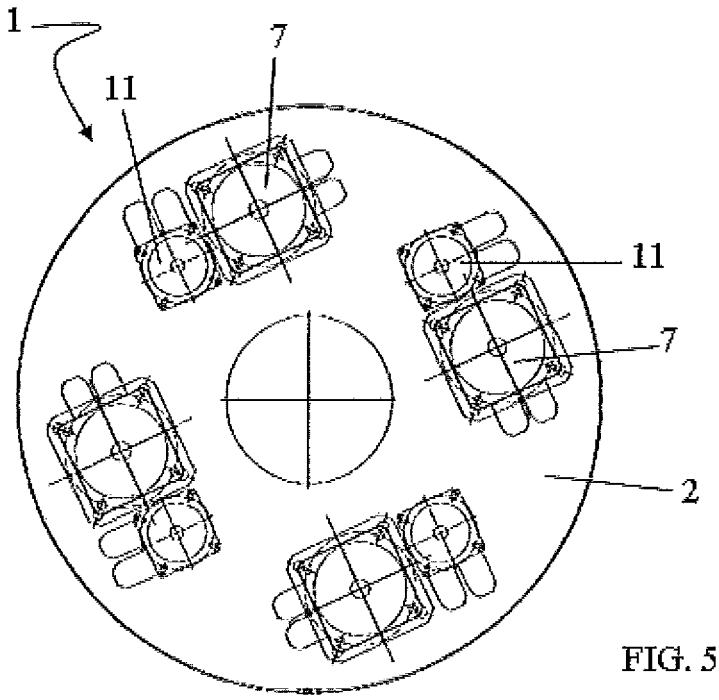
FIG. 5 shows a sectioned view of the seamer of FIG. 1, according to the plane indicated by the reference C in FIG. 1.

To the carousel 2 is associated a plurality of seaming stations 3; in the illustrated example (FIGS. 3-5), the seamer 1 comprises four seaming stations 3. The seaming stations 3 are substantially identical to each other and preferably positioned symmetrically on the carousel.

Figure 1:
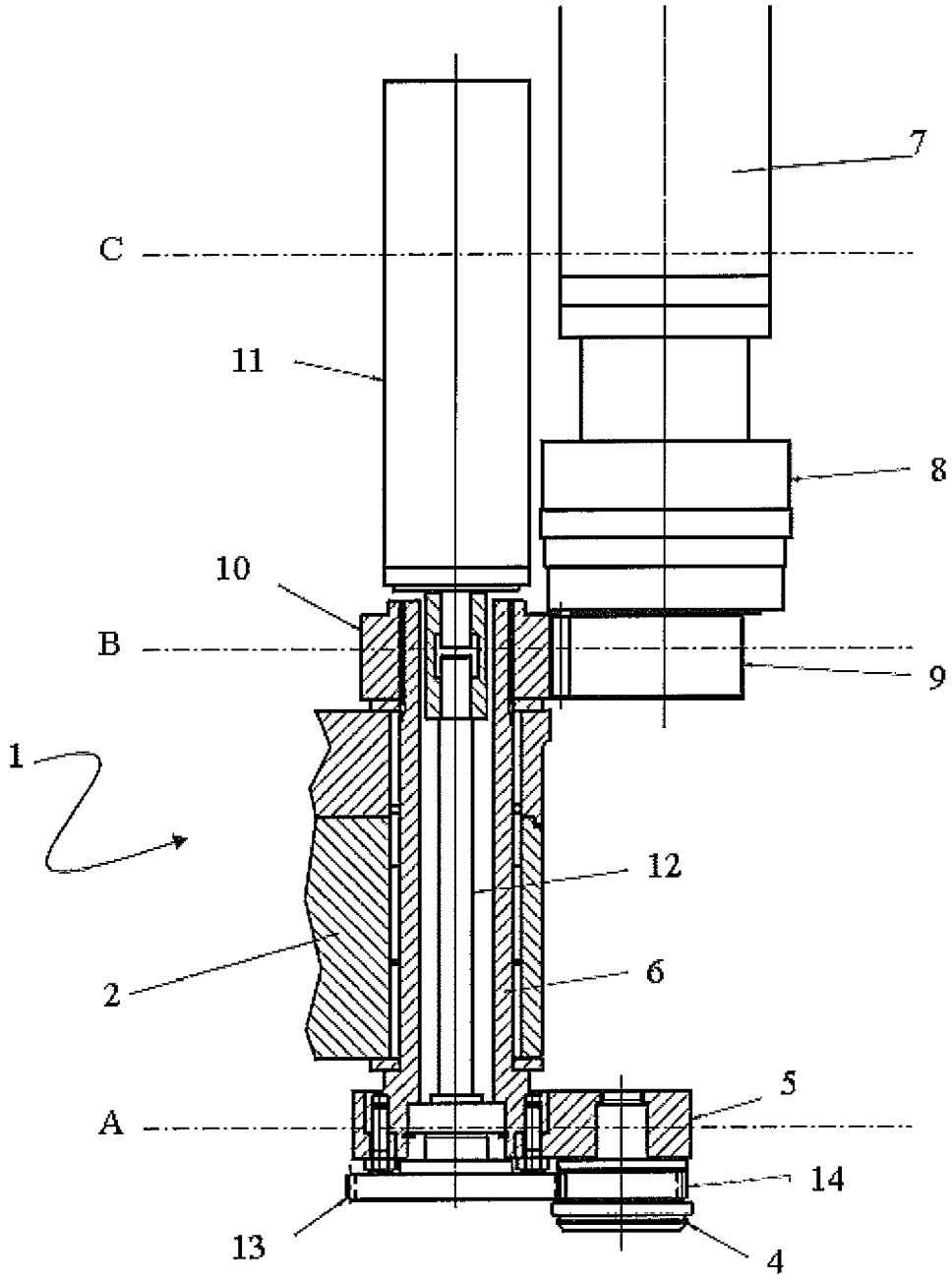
FIG. 1 shows a sectioned lateral view of a seaming station of a seamer according to the present invention.
Figure 2:
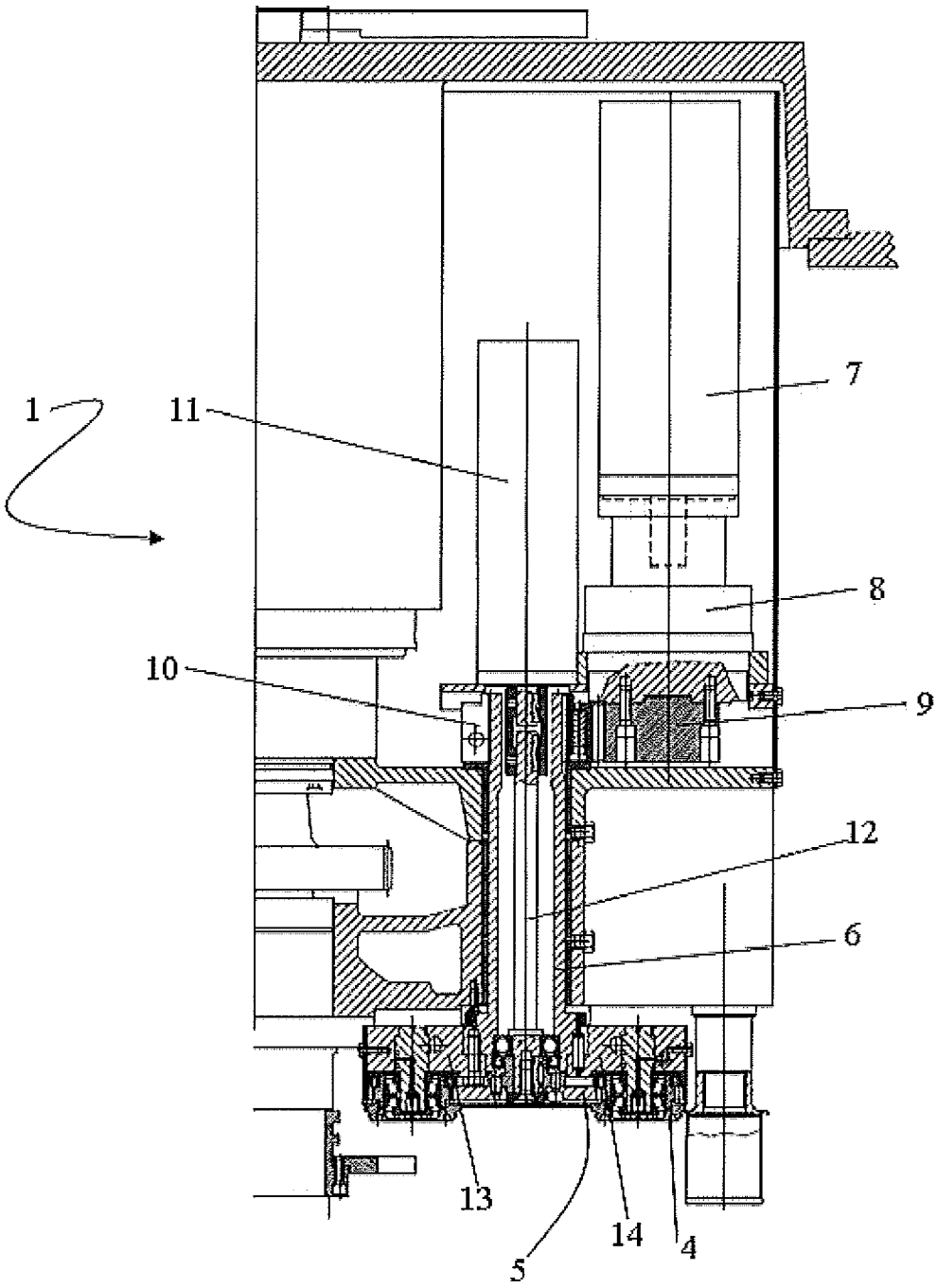
FIG. 2 shows the seaming station of FIG. 1, in greater detail.

FIGS. 1 and 2 show in particular one of said seaming stations 3.

The seaming station comprises a roller 4 mounted on a lever 5 integral with a rod-like element 6 rotatably coupled to the carousel 2.

The roller 4 constitutes a seaming tool that, operatively, comes in contact with an object to be seamed positioned on a mandrel or another rotary element (not shown in the figures because it is known) associated with the carousel 2.

The roller 4 is movable from an operative position, in which it interacts with the object seaming it, to a deactivated position, of non interference with the object.

The action of the roller 4 on the object depends on the lateral profile of the roller 4; in this light, to the lever 5 is also associated an additional roller, having a different profile. The rollers 4 are positioned at the ends of the lever 5.

The actuation of the roller 4 (or of each of the two rollers 4 associated with the lever 5) from the operative position to the deactivated position and vice versa occurs by means of a rotation of the rod-like element 6 around its own longitudinal axis.

In particular, the rod-like element 6, originally, is connected to an electric motor 7 associated with the carousel 2.

The electric motor 7 is coupled to a reduction unit 8 and to a first transmission member 9 (preferably constituted by a sector gear), which meshes in a second toothed transmission member 10 integral with the rod-like element 6. Therefore, said first transmission member 9 and second transmission member 10 constitute a gear system defining means for connecting the rod-like element 6 to the electric motor 7.

Preferably, each seaming station comprises its own electric motor 7 coupled to the corresponding rod-like element 6 by connecting means of the type described above.

The seamer 1 also comprises, originally, an electrical panel (not shown in the figures because it is known in itself) associated with the carousel 2 and connected to all the electric motors 7 of the various seaming stations.

Moreover, the seamer 1 also comprises at least one electronic board (or other control means not shown because they are known in themselves) connected to the electric motor 7 to control it. In this way, the displacement of the roller 4 is managed by electronic control means through the electric motor 7. In particular, the control means are operatively active on the electric motor 7 to rotate the rod-like element 6 according to a predefined logic.

Said predefined, according to which is actuated the roller 4, defines the velocity profile of the roller 4. Therefore, said logic determines the velocity with which the roller 4 is actuated and the time of permanence of the roller 4 in the operative position.

Preferably, the control means interact with a software defining said predefined logic.

Note that, preferably, the control means are contained in the electrical panel and are connected with all the electric motors 7 of the respective seaming stations 3. In any case, each motor can be controlled to independently.

Preferably, the panel is contained in a case (not shown in the figures because it is known in itself) defining an electrical insulation and it is maintained there in a pressurized environment. This advantageously enables to enhance the hygiene and safety of the seamer.

Note that managing the displacement of the roller 4 by means of an electronically controlled electric motor provides the following advantages.

In the first place, all adjustment operations to adapt the seamer to the treatment of objects differing in terms of format or material are particularly simple and can be carried out automatically. In particular, the control means enable to vary automatically (possibly on all seaming stations simultaneously) the position of the roller 4 relative to the mandrel (or relative to the object to be seamed), in the deactivated or operative position. Moreover, the control means enable to vary automatically the number of seaming turns, by varying the time of permanence of the roller 4 in the operative position.

This enables always to operate in optimized conditions, with the possibility to adapt rapidly and automatically to the different formats of the treated containers and to the different materials of the treated objects. Note also that, originally, the seamer 1 comprises a first motorization operatively connected to the carousel 2 to set it in rotation and a second motorization operatively connected to the mandrel to set it in rotation around its own axis, said first and second motorization (not shown because known in themselves, constituted for example by electric motors) being independent of each other. The control means are operatively connected to said first and second motorization. In this way, the actuation of the roller 4 is managed automatically, also as a function of the angular velocities of the carousel 2 and of the mandrel (hence of the object to be seamed) with the possibility to vary said velocities at will.

This additional characteristic further provides freedom and flexibility in the management of the number of seaming turns.

Moreover, by acting automatically on the control means, it is possible to activate or deactivate the additional roller 4 associated with the lever 5, with no need for any manual mechanical intervention.

The seamer is also provided with a sensor to sense the position of the roller 4 relative to the mandrel and transmit the sensed value to the adjustment means. This advantageously enables to adjust the position of the roller 4 relative to the mandrel automatically compensating any plays and construction tolerances.

Moreover, the control means preferably comprise a diagnostic signaller (e.g. of the software type, but also of the luminous or acoustic type) activated according to the trend in the value of a control quantity of the electric motor 7 (e.g. a control current).

This advantageously enables automatically to detect malfunction situations of the seamer, e.g. jams, and automatically to stop the operation of the seamer.

The electronic management of the displacement of the rollers enables a feedback control of the seaming torque (i.e. of the torque applied by the electric motors 7) of each individual seaming station 3 with the possibility to signal false seams.

Defining said predefined software with a software and managing the seaming operation (i.e. the displacement of the roller 4) electronically, it is advantageously possible to store all the adjustment and operating parameters of the seamer, to subsequently analyze them and modify them remotely. In this light, the seamer comprises (preferably integrated in the electrical panel) means for transmitting and receiving data about the operation of the seamer.

Moreover, in the seamer 1 according to the present invention the roller 4 is, originally, motorized.

The seamer originally comprises an electric actuator 11 (e.g. a gearmotor) associated with the carousel 2 kinetically connected to the roller 4 to set it in rotation around its longitudinal axis, in the opposite direction from the direction of rotation of the object to be seamed.

In particular, the seamer 1 comprises a pivot 12 having a first end connected to the electric actuator 11 and a second end connected to a system of gears associated with the lever 5 and connected to the roller 4. For example, said system of gears comprises a first gear 13 integral with the pivot 12 coupled to a second gear 14 integral with the roller 4.

In the preferred embodiment illustrated, the rod-like element 6 is internally hollow and the pivot 12 is housed within the rod-like element 6.

Preferably, the control means are operatively active also on the electric actuator 11, to manage the rotation of the roller 4 (or of the seaming tool) ID according to the rotation of the rod-like element, by means of a co-ordinated control of the electric motor 7 and of the electric actuator 11.

In particular, the control means are operatively active on the electric actuator 11 to adjust its velocity of rotation.

In this way, it is possible to set in rotation the roller 4 and to adjust its velocity of rotation according to the position of the roller 4 itself and/or of the velocity of displacement of the roller 4 (from the deactivated position to the operative position or vice versa).

Preferably, at least one of the rollers 4 (more preferably each roller) is internally provided with pre-loaded bearings. This is made possible by the fact that the roller is not idle, but is motorized.

This allows, advantageously, a significant increase in the stiffness of the roller 4.

Moreover, the roller 4 defines a hermetic container of lubricating fluid, necessary for the rotation of the roller itself.

This characteristic also is made possible by the fact that the roller 4 is not idle but motorized, and it has the advantage of improving the seamen from the viewpoint of hygiene.

An additional advantage associated with the motorization of the roller 4 is that of avoiding contact between the object to be seamed, which rotates integral with the mandrel, with an idle roller which, at the time of contact between roller and object, has zero angular velocity. By motorizing the roller it is possible to impart it a peripheral velocity substantially equal to that of the object (and with opposite direction) in order to avoid rubbing between roller and object (upon contact), whereto are associated phenomena of wear, removal of material and consequent jams.

The invention claimed is:

1. A rotary seamer (1) provided with a carrousel (2) and with at least one seaming station (3) associated with the carrousel (2) and comprising:

a rod element (6) rotating around its own longitudinal axis;

a seaming tool (4) rotatably connected to a lever (5) integral with the rod element (6);

means for rotating the rod element (6) around its own longitudinal axis, in order to displace the seaming tool (4) from an operative position, in which it interacts with an object seaming it, to a deactivated position, of non interference with the object;

characterised in that said means for rotating the rod element (6) comprise, in combination:

an electric motor (7) associated with the carrousel;

means for connecting the rod element (6) to the electric motor (7), said means for connecting the rod element (6) to the electric motor (7) comprising a system of gears (9, 10);

control means operatively active on the electric motor (7) to rotate the rod element (6) according to a predefined logic.

2. Seamer as claimed in claim 1, comprising, in combination:

an electric actuator (11) associated with the carrousel (2);

means for connecting said electric actuator (11) to the seaming tool (4), to rotate it around its own longitudinal axis.

3. Seamer as claimed in claim 2, wherein said control means are operatively active also on the electric actuator (11), to manage the rotation of the seaming tool (4) according to the rotation of the rod element, by means of a co-ordinated control of the electric motor (7) and of the electric actuator (11).

4. Seamer as claimed in claim 3, wherein said control means are operatively active on the electric actuator (11) to adjust its velocity of rotation.

5. Seamer as claimed in claim 2, wherein said electric actuator (11) is connected to the seaming tool (4) in such a way as to rotate it in the opposite direction with respect to the direction of rotation of the object to be seamed.

6. Seamer as claimed in claim 2, wherein said seaming tool (4) is a roller internally provided with pre-loaded bearings.

7. Seamer as claimed in claim 1, wherein said control means comprise an electronic board connected to a sensor able to sense an angular position of the carrousel (2).

8. Seamer as claimed in claim 1, comprising an additional seaming tool (4) rotatably associated to said lever (5).

9. Seamer as claimed in claim 1, wherein said control means comprise a diagnostic signaller activated according to the trend in the value of a control quantity of the electric motor (7).

10. Seamer as claimed in claim 1, comprising a plurality of seaming stations (3) associated with the carrousel (2) and an electrical panel connected to all electric motors (7) and to the control means of the respective seaming stations (4).

11. Seamer as claimed in claim 10, wherein said electrical panel is contained in a pressurised environment.

12. A rotary seamer (1) provided with a carrousel (2) and with at least one seaming station (3) associated with the carrousel (2) and comprising:

a rod element (6) rotating around its own longitudinal axis;

a seaming tool (4) rotatably connected to a lever (5) integral with the rod element (6);

means for rotating the rod element (6) around its own longitudinal axis, in order to displace the seaming tool (4) from an operative position, in which it interacts with an object seaming it, to a deactivated position, of non interference with the object;

characterised in that said means for rotating the rod element (6) comprise, in combination:

an electric motor (7) associated with the carrousel;

means for connecting the rod element (6) to the electric motor (7), said means for connecting the rod element (6) to the electric motor (7) comprising a system of gears (9, 10);

control means operatively active on the electric motor (7) to rotate the rod element (6) according to a predefined logic, the control means interacting with a software defining said predefined logic, to adjust the time of permanence of the seaming tool (4) in the operative position.

13. Seamer as claimed in claim 12, wherein said control means comprise a diagnostic signaller activated according to the trend in the value of a control quantity of the electric motor (7).

14. Seamer as claimed in claim 12, comprising, in combination:

an electric actuator (11) associated with the carrousel (2);

means for connecting said electric actuator (11) to the seaming tool (4), to rotate it around its own longitudinal axis.

15. A rotary seamer (1) provided with a carrousel (2) and with at least one seaming station (3) associated with the carrousel (2) and comprising:

a rod element (6) rotating around its own longitudinal axis;

a seaming tool (4) rotatably connected to a lever (5) integral with the rod element (6);

means for rotating the rod element (6) around its own longitudinal axis, in order to displace the seaming tool (4) from an operative position, in which it interacts with an object seaming it, to a deactivated position, of non interference with the object;

characterised in that said means for rotating the rod element (6) comprise, in combination:

an electric motor (7) associated with the carrousel;

means for connecting the rod element (6) to the electric motor (7), said means for connecting the rod element (6) to the electric motor (7) comprising a system of gears (9, 10);

control means operatively active on the electric motor (7) to rotate the rod element (6) according to a predefined logic, the control means interacting with a software defining said predefined logic, to adjust the velocity of actuation of the seaming tool (4) from the deactivated position to the operative position.

16. Seamer as claimed in claim 15, wherein said control means comprise a diagnostic signaller activated according to the trend in the value of a control quantity of the electric motor (7).

17. Seamer as claimed in claim 15, comprising, in combination:

an electric actuator (11) associated with the carrousel (2);

means for connecting said electric actuator (11) to the seaming tool (4), to rotate it around its own longitudinal axis.

* * * * *